United States Patent [19]

Irwin et al.

[11] Patent Number: 4,734,164

[45] Date of Patent: Mar. 29, 1988

[54] HORIZONTAL WEB-FORMING APPARATUS WITH CURVED NOSE FORMING BOARD

[75] Inventors: Jeffery C. Irwin, Clinton, Wis.; John H. Schamell, Roscoe, Ill.; Jay A. Shands, Beloit, Wis.

[73] Assignee: Beloit Corporation, Beloit, Wis.

[21] Appl. No.: 881,999

[22] Filed: Jul. 3, 1986

[51] Int. Cl.[4] ..... D21F 1/06; D21F 1/36

[52] U.S. Cl. ..... 162/348; 162/336; 162/352; 162/354

[58] Field of Search ..... 162/348, 353, 347, 301, 162/212, 350, 351, 352, 354, 336

[56] References Cited

U.S. PATENT DOCUMENTS

| | | | |
|---|---|---|---|
| 1,563,095 | 11/1925 | Lewthwaite . | |
| 2,418,600 | 4/1947 | Ostertag et al. . | |
| 3,357,880 | 12/1967 | Curtis | 162/344 |
| 3,438,854 | 4/1969 | Means | 162/352 |
| 3,582,465 | 6/1971 | Salomon | 162/212 |
| 3,726,758 | 4/1973 | Parker et al. | 162/301 |
| 3,855,057 | 12/1974 | Hill | 162/301 |
| 3,876,499 | 4/1975 | Vesanto | 162/301 |
| 3,902,961 | 9/1975 | Roerig et al. | 162/347 |
| 3,992,254 | 11/1976 | Lehtinen | 162/301 |
| 3,997,390 | 12/1976 | Kankaanpaa | 162/347 |
| 4,033,812 | 7/1977 | Riihinen | 162/301 |
| 4,154,645 | 5/1979 | Kankaanpaa | 162/301 |
| 4,523,978 | 6/1985 | Pulliren | 162/352 |
| 4,609,435 | 9/1986 | Tissari | 162/301 |

*Primary Examiner*—S. Leon Bashore
*Assistant Examiner*—K. M. Hastings
*Attorney, Agent, or Firm*—Dirk J. Veneman; Raymond W. Campbell; Gerald A. Mathews

[57] ABSTRACT

A system for forming a web from a dilute, aqueous slurry of fibers wherein a thin, horizontally-extending aqueous stream of fibers is projected onto a travelling foraminous forming wire. The forming wire is disposed to travel over a forming board which has a leading lip which is deflected downwardly with respect to the oncoming jet stream. The lower surface of the jet stream is disposed substantially parallel with the surface of the travelling foraminous wire wire at the point where the stream contacts the wire to minimize turbulence at the point of initial contact of the jet stream on the wire and subsequent spouting of the fibrous stock downstream in the forming zone.

9 Claims, 2 Drawing Figures

HORIZONTAL WEB-FORMING APPARATUS WITH CURVED NOSE FORMING BOARD

BACKGROUND OF THE INVENTION

This invention relates to the art of web forming wherein the web is formed from a dilute, aqueous slurry of fibers. More specifically, this invention relates to the formation of a paper web and, still more specifically, to the formation of a paper web on a so-called fourdrinier type of papermaking machine.

High speed papermaking machines can be broadly classified into two major types: fourdrinier and twin-wire machines. In twin-wire papermaking machines, a dilute, aqueous slurry of wood fibers is projected between a pair of converging forming wires which are travelling in the direction of the projecting stream. This aqueous stream of wood fibers is commonly referred to as "stock" in the paper industry. In twin-wire forming apparatus, stock dewatering is performed through both of the travelling forming wires so the stock jet stream is directed to the center of a throat defined by the converging forming wires to facilitate and promote equal drainage through each of the forming wires. This centered positioning of the stock jet also takes advantage of the fact that twin-wire formers usually operate with their co-running forming wires travelling in a non-horizontal path in order to utilize the force of gravity in urging water through each of the forming wires.

On the other hand, fourdrinier type papermaking machines are horizontally, or nearly horizontally, disposed since the water is only removed downwardly through a single forming wire on which the aqueous slurry of wood pulp fibers is deposited.

Accordingly, the stock jet cannot be directed into a non-existent throat between converging forming wires but must instead be directed onto the horizontally-arrayed fourdrinier forming wire. The web forming zone extends from the breast roll at the beginning of the fourdrinier to the couch roll at its end.

Over the years, as papermaking machine speeds have increased, different pulping methods were developed to more uniformly refine the wood pulp. Dewatering apparatus disposed beneath the fourdrinier wire were also developed and improved so quality paper could be formed at progressively higher speeds. However, the problem of spouting, wherein droplets of stock are projected upwardly from the fourdrinier wire by surface disturbances remained and increased in intensity as forming speeds increased. At lower papermaking speeds, and sometimes in consideration of other factors such as stock grades, spouting was not considered a problem, much less a major problem. Indeed, there was a time when so-called "shake" mechanisms were built into the fourdrinier section in order to produce or maintain a certain amount of stock agitation while it was in a fluid form on the fourdrinier wire before a sufficient amount of water was drained to form a cohesive web. It was thought, and still is, that a small, limited amount of stock agitation was beneficial to web formation.

However, at today's papermaking speeds, which range from about 2,000 feet per minute to about 5,000 feet per minute, even the extent of spouting activity on the fourdrinier wire which might have been considered tolerable, or even beneficial, at lower machine speeds, or in comparison with paper formed under lower standards in the past, have now become undesirable and unacceptable. In all cases, at high machine speeds, the degree of spouting must be controlled as excessive spouting is detrimental to the production of quality paper.

Prior attempts to produce better paper formation at increased speed included slanting the fourdrinier wire downwardly, or upwardly, or projecting the stock jet onto the fourdrinier wire as it travelled over the breast roll. However, each of these attempts had its own deficiencies and limitations to the net effect that the paper formed by such apparatus either was of inferior quality, or had to be produced at lower speed, or some combination of both.

Fourdrinier papermaking machines utilize a forming board which is a dewatering device located immediately downstream of the breast roll. A prime source of the spouting phenomenon on prior fourdrinier papermaking machines was the turbulence caused by impingement of the stock stream against the forming wire over the forming board. The forming board could not be removed since it was needed to both support the forming wire under the weight of the aqueous slurry of stock and control the drainage of the water during the initial, critical stage of paper formation.

SUMMARY OF THE INVENTION

The spouting problems associated with fourdrinier type papermaking machines have been diminished considerably by this invention. The invention resides in lowering the breast roll slightly so that the fourdrinier wire travels upwardly at a small angle from the breast roll to reach the nose surface of the forming board. The downstream portion of the forming board extending from the nose surface is arrayed in the conventional horizontal plane typical of fourdrinier type papermaking machines. The nose surface of the forming board can be flat or slightly curved downwardly in the direction toward the breast roll.

In combination with the lowered breast roll, the headbox, or former, slice apron lip is also disposed lower than it would be on other fourdrinier type machines. This allows the stock jet stream of comingled fibers to be projected onto the forming wire over the forming board nose surface at either a very small angle or tangentially, as desired. It also permits the jet stream issuing from the slice to be under sufficient pressure to travel at such a speed that there is little, or no, curvature of the jet before it intercepts the fourdrinier wire. Since the angle of contact, or impingement, is very small, or tangential, relative to the travelling fourdrinier wire at the point of contact, surface disturbances caused by impingement of the stock stream against the forming wire are reduced, thus mitigating the magnifying effect of the stock stream directional change.

The essentially flat flow path of the stock stream from the slice lip to the area of contact over the forming board nose in conjunction with decreased surface disturbance of the stock after it has contacted the fourdrinier wire means that higher forming speeds can be provided with the same, or reduced, surface disturbance of the stock on the forming wire. By reducing the angle of impingement of the stock stream against the forming wire over the forming board, the degree of spouting is both decreased and controlled.

Accordingly, it is an object of this invention to provide apparatus for pr jecting and receiving a stock stream essentially tangentially onto a fourdrinier forming wire.

Another object of this invention is to provide a fourdrinier type web forming apparatus wherein the path of stock travel from the slice to the fourdrinier forming wire has a minimum of curvature.

Still another object of this invention is to provide a fourdrinier type of web forming apparatus wherein the force of impingement of the stock stream on the forming board is reduced.

A feature of this invention is the provision of a downwardly slanting fourdrinier wire over the forming board extending in the upstream direction.

Another feature of this invention is that the plane of the forming zone over the forming board is higher than a parallel plane tangent to the top of the fourdrinier breast roll.

Still another feature of this invention is the provision of the lower slice lip substantially parallel with the plane of the fourdrinier forming zone.

Still another feature of this invention is the curved nose on the upstream end of the forming board.

These and other objects, features and advantages of this invention will become readily apparent to those skilled in the art when the following description of the preferred embodiments are read in conjunction with the drawings.

DESCRIPTION OF THE PREFERRED EMBODIMENTS

Figure 1:
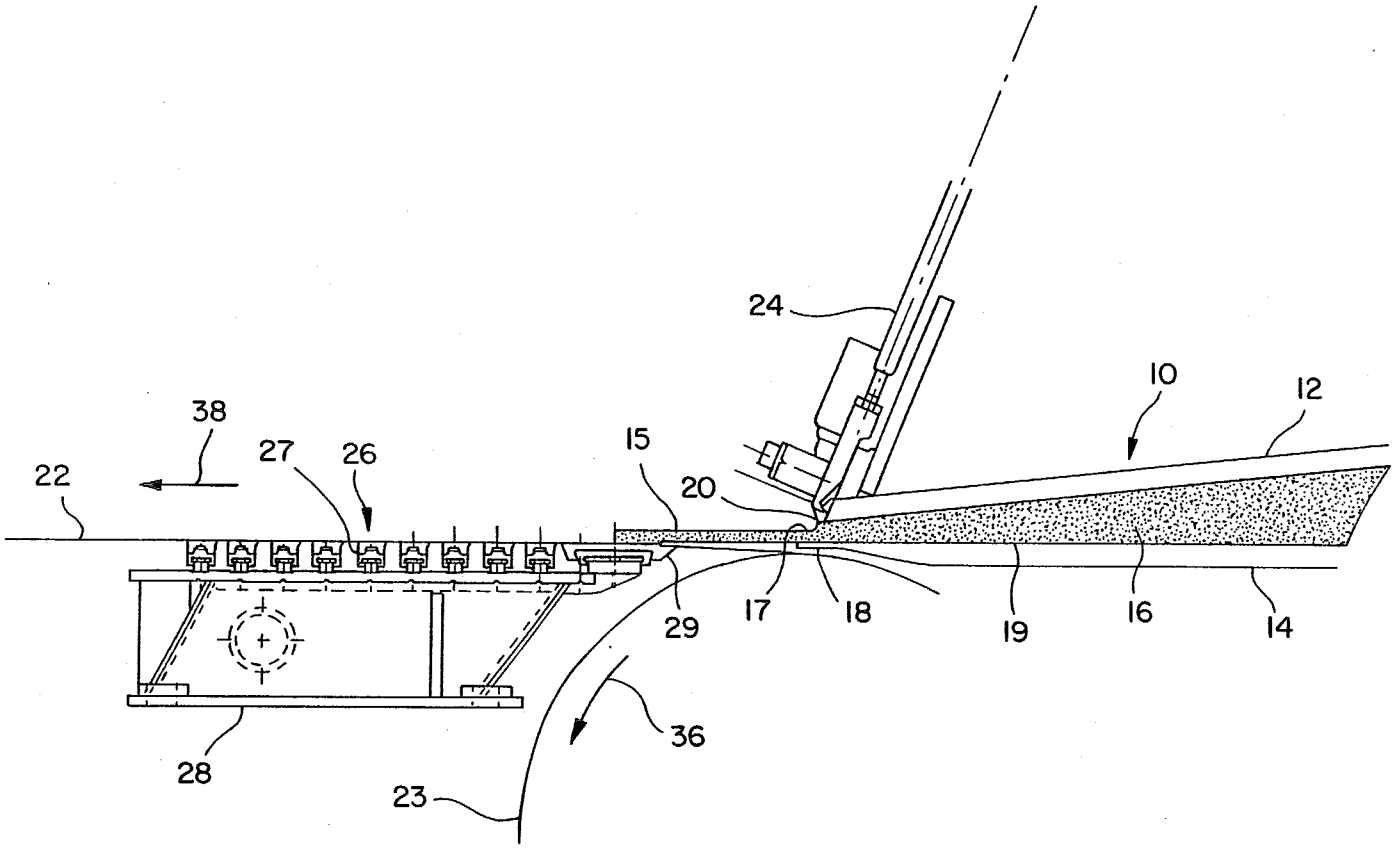
FIG. 1 is a side elevational view of the front end of the forming section on a fourdrinier type papermaking machine showing the stock jet stream emitting from the headbox onto the forming board.
Figure 2:
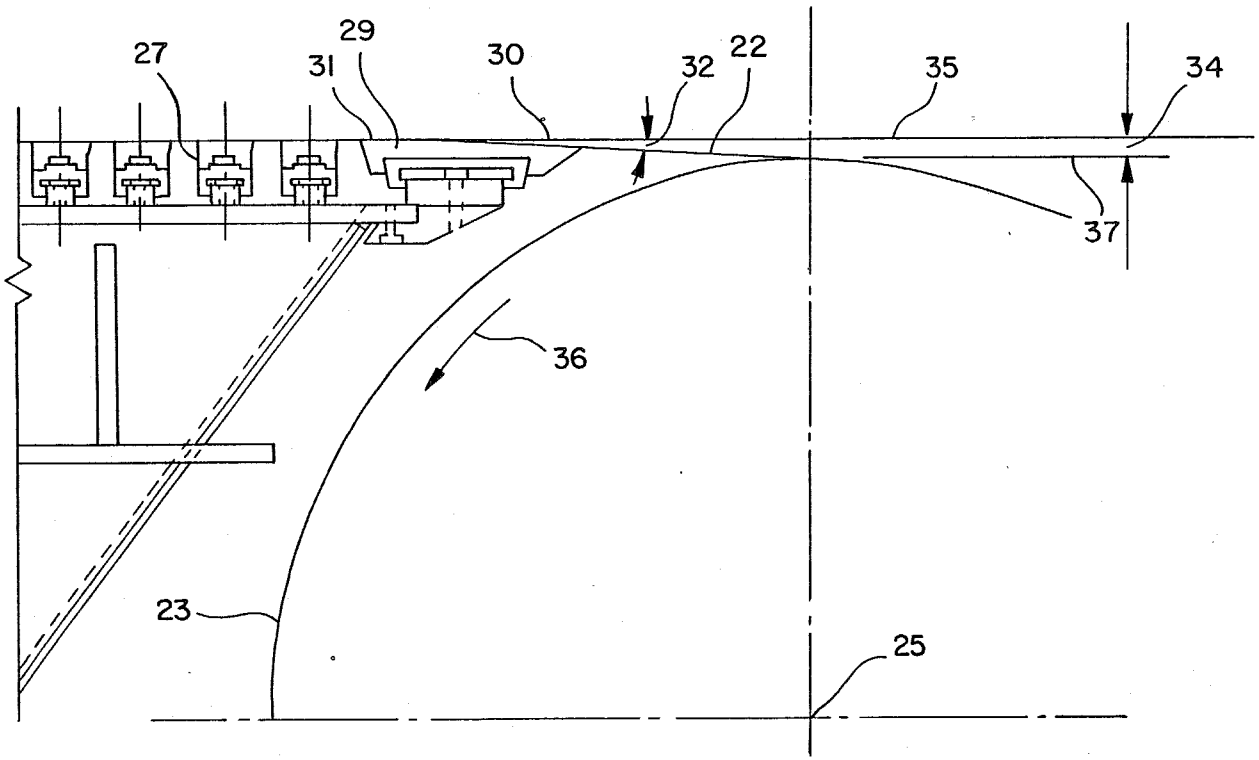
FIG. 2 is also a side elevational view of a fourdrinier type papermaking machine showing a closer view of the forming board and its position relative to the breast roll.

Referring to FIGS. 1 and 2, the beginning of the forming zone on a fourdrinier type papermaking machine is shown wherein a source of stock, which may be a headbox or former 10 having upper and lower walls 12,14 respectively, defining a slice chamber 16 which is disposed above the breast roll on the fourdrinier. A forming board, generally designated 26, is positioned within the looped fourdrinier forming wire 22 in spaced downstream adjacency to the headbox slice opening 17.

The forming board includes a support beam 28 on which a plurality of wear-resistant dewatering elements, such as foils 27, are mounted in supporting engagement with the underside of the fourdrinier wire 22. Foils 27, together with the trailing surface 31 of shoe 29, define a dewatering surface which is generally in a plane. This downstream dewatering surface can take many forms, such as perforated, slotted and combinations thereof. Its construction and function are well-known to those skilled in the art and will not be discussed in further detail. A curved shoe 29 is located at the front, or leading, end of the forming board. The leading surface, or nose 30, of the shoe is shown curved downwardly in the upstream direction toward the headbox slice opening 17.

The fourdrinier wire 22 is looped over the breast roll 23 and diverges upwardly at a small angle such as, for example, 1°–10°, which is designated 32 in FIG. 2, from the top of the breast roll. Angle 32 is created by lowering the breast roll axis of rotation 25 so that its uppermost surface is beneath the level of the fourdrinier forming wire over the dewatering elements 27. The fourdrinier forming wire 22 travels over the top of the dewatering foil elements 27 and downstream through the fourdrinier forming zone extending between the breast roll and couch roll (not shown) in a substantially horizontal plane as exemplified by its path of travel over the dewatering elements 27. However, as previously described, the forming wire 22 travels upwardly at a slight angle from the point where it leaves the top of the breast roll to the point where it is received onto the downwardly extending nose 30 of curved shoe 29 on the forming board. In other words, the forming wire 22 travels upwardly from its tangency to breast roll 23 to its tangency to curved nose 30 of shoe 29. Thus, a plane tangent to the curved nose surface at any point will diverge downwardly in the upstream direction from a plane along the dewatering trailing surface 31. Conversely, the planar trailing surface 31 will diverge downwardly in the downstream direction relative to a plane tangent to any point on the curved nose surface 30.

This upward path of travel between the breast roll and curved shoe creates a vertical space 34, shown in FIG. 2, between a horizontal plane 35 of forming wire 22 travel over the forming board dewatering elements 27 (and the remainder of the fourdrinier forming zone) and a horizontal plane 37 which passes through the point of tangency of the forming wire 22 on the surface of breast roll 23.

Referring now to FIG. 1, the headbox apron lip 18 is brought up over the top of breast roll 23 in the space 34 so that the inner surface 19 of lower wall 14 is coincident, or substantially coincident, with plane 35. The upper slice lip 20 of the former 10 is adjusted by a plurality of slice lip adjusting rods 24 to produce the desired stock jet stream 15 emitting from the former.

Since the axis of rotatio of the breast roll has been lowered to create space 34 to produce the upward portion of forming wire travel between the breast roll and nose surface 30 of curved shoe 29, the stock jet stream 15 impinges upon the forming wire 22 over the curved nose 30 of the forming shoe at a very small angle approaching tangency. A preferred angle is about 0° to about 2°. This greatly diminishes the force of impact of the stock stream onto the forming wire over the curved shoe nose surface because the stock stream 15 is essentially straight during its path of travel from the slice 17 to the curved shoe 29 and its contact with the curved shoe is essentially tangent.

By creating space 34 to provide an upwardly directed span of the fourdrinier forming wire 22 between the breast roll and nose surface of the shoe 29, the surface of the curved shoe on which the stock stream impinges, which is preferred to be a downstream portion thereof, but which may be any portion of shoe 29, is brought upwardly relative to the lower surface of the stock jet stream 15, defined initially by apron lip 18, so as to lessen, or even eliminate, curvature of the stock jet stream and its drop which otherwis would occur if the slice opening 17 were substantially above, or further away, from curved shoe 29, or both. Decreased curvature of the stock stream means a smaller angle of impingement which produces a smaller impact force of stock against the forming wire and forming board. When the stock jet stream curves during its path of travel onto the forming board, as it does in prior fourdrinier configurations, the angle of its impact relative to the surface on which it impinges is relatively large.

Another factor diminishing the force of stock impact against the forming board with this configuration is that the forming wire 22 is travelling slightly upwardly in the downstream direction over nose surface 30 so any slight downward curvature of the stock stream, which would be expected to be greatest at its furthest distance from the slice opening, will be intercepted by the wire at a slightly higher location to further lessen the extent of its angle of impingement and concomitant creation of turbulence and subsequent spouting further downstream in the direction of arrow 38. This corresponds with the direction of rotation 36 of the breast roll.

It is contemplated that various modifications can be made in the invention without departing from the spirit or scope of the claims. For example, the curved nose surface 30 could take the form of a small diameter rotating roll. The nose surface could include a flat portion so long as its transition into the top surface along plane 35 is smooth. The radius of curvature of the surface of curved shoe 29 is not restricted to one dimension. A radius of 100 inches has been found to produce satisfactory results. Also, while fourdrinier type papermaking machines almost universally utilize a horizontally-disposed forming wire 22 travelling through the forming section from the forming board 26 to the couch roll, it is contemplated that the forming wire could be at a small angle in which case the angle 32 of the forming wire between the breast roll and the curved shoe 29 would be adjusted accordingly as would the position of the stock former 10. In other words, the entire apparatus could be rotated to maintain the relative positions of the components.

What is claimed is:

1. In an apparatus for forming a web from a stock jet stream, including a former for projecting the stock stream from its slice, a single, substantially horizontally arranged, looped forming wire, a breast roll and a forming board, each mounted within the looped forming wire with the forming board directly adjacent the breast roll, the improvement comprising:

the forming board includes a curved shoe having a place of impingement of the stock stream, a substantially curved nose surface and a substantially planar downstream surface diverging therefrom;

the breast roll is mounted with its upper peripheral surface disposed beneath a plane extending along the downstrem surface;

the forming wire extends between the upper peripheral breast roll surface and the nose surface at a small angle of about 1° to about 10° relative to the plane along the downstream surface; the former slice is positioned over the breast roll to project the stock stream onto the forming wire over the forming board at a small angle of about 0° to about 2° thereto at the place of impingement.

2. An apparatus for forming a web as set forth in claim 1, wherein:

the forming board is positioned to intercept the stock stream on its nose surface.

3. An apparatus for forming a web as set forth in claim 1, wherein:

the former slice is positioned to direct the stock stream onto the nose surface substantially tangentially thereto.

4. An apparatus for forming a web as set forth in claim 1, wherein:

the former slice is positioned to dirct the stock stream onto the forming wire over the forming board beneath the plane extending along the downstream surface.

5. An apparatus for forming a web as set forth in claim 1, wherein:

the former slice is positioned to direct the stock stream onto the forming wire over the forming board substantially along the plane extending along the downstream surface.

6. An apparatus for forming a web from a stock jet stream, including a former for projecting the stock stream from its slice, a single, substantially horizontally arranged, looped forming wire, a breast roll and a forming board apparatus, both mounted within the looped forming wire with the forming board directly adjacent the breast roll, comprising in combination:

the forming board apparatus includes a substantially planar trailing downstream surface and a curved shoe having a place of impingement of the stock stream and a substantially curved nose surface diverging downwardly from the trailing downstream surface in the upstream direction;

the breast roll is mounted with its upper peripheral surface disposed beneath a plane extending along the downstream surface;

the forming wire extends between the upper peripheral breast roll surface and the nose surface at a small angle of about 1° to about 10° relative to the plane along the downstream surface;

the former slice is positioned over the breast roll to project the stock stream onto the forming wire over the curved shoe substantially tangentially at the place of impingement.

7. An apparatus as set forth in claim 6, wherein:

the downstream surface extends in a substantially horizontal plane;

the former slice is positioned to project the stock stream in a substantially horizontal path.

8. An apparatus as set forth in claim 6, wherein:

the former slice is positioned over the breast roll to project the stock stream along a path beneath the plane extending along the downstream surface of the forming board.

9. An apparatus as set forth in claim 6, wherein:

the former slice is positioned over the breast roll to project the stock stream along a path substantially along the plane extending along the downstream surface of the forming board.

* * * * *